US005152463A

United States Patent [19]

Mao et al.

[11] Patent Number: 5,152,463

[45] Date of Patent: Oct. 6, 1992

[54] ASPIRATING SIMPLEX SPRAY NOZZLE

[75] Inventors: Chien-Pei Mao, Clive; Roy E. Pack, Jr., Winterset, both of Iowa

[73] Assignee: Delavan Inc., West Des Moines, Iowa

[21] Appl. No.: 774,011

[22] Filed: Oct. 8, 1991

[51] Int. Cl.[5] ..... B05B 1/34

[52] U.S. Cl. ..... 239/402; 239/428.5; 239/466; 239/468; 239/490; 239/492

[58] Field of Search ..... 239/402, 405, 428.5, 239/463, 466, 468, 490, 492, 493

[56] References Cited

U.S. PATENT DOCUMENTS

| | | | |
|---|---|---|---|
| Re. 30,003 | 5/1979 | Reed | 239/11 |
| Re. 30,004 | 5/1979 | Reed | 239/468 |
| 2,286,581 | 6/1942 | Scott | 239/405 X |
| 2,321,428 | 6/1943 | Schloz | 239/466 |
| 2,434,721 | 1/1948 | Rowley | 239/492 |
| 2,721,765 | 10/1955 | Greenland | 239/492 X |
| 2,904,263 | 9/1959 | Tate et al. | 239/494 |
| 3,680,793 | 8/1972 | Tate et al. | 239/468 |
| 3,708,119 | 1/1973 | Vicard | 239/11 |
| 3,762,651 | 10/1973 | Condolios | 239/468 |

FOREIGN PATENT DOCUMENTS

| | | | |
|---|---|---|---|
| 957978 | 9/1982 | U.S.S.R. | 239/466 |
| 1437097 | 11/1988 | U.S.S.R. | 239/466 |

*Primary Examiner*—Andres Kashnikow
*Assistant Examiner*—William Grant
*Attorney, Agent, or Firm*—Howard S. Reiter

[57] ABSTRACT

A spray nozzle designed to produce a spray or mist containing a high concentration of bubbles. Such a spray is particularly useful in mixing liquid fuel and air for burning within a combustion chamber, as for example in a gas turbine engine. The novel design includes a pair of swirl chambers generally axially aligned within the nozzle. Fuel or other liquid enters the first or forward swirl chamber in a generally tangential and laminar flow pattern, passes into the second or rearward chamber through an interconnecting orifice. Violent liquid and air mixing occurs in the second chamber and the mixture is then expelled as an aerated spray through the interconnecting orifice, the first chamber and a discharge orifice.

15 Claims, 3 Drawing Sheets

ASPIRATING SIMPLEX SPRAY NOZZLE

BACKGROUND OF THE INVENTION

1. Field of the Invention

This invention relates generally to nozzles for spraying liquids and it relates more specifically to an improvement that enhances the formation of bubbles in the fluid discharged by a simplex pressure atomizer or spray nozzle.

2. Background Art

Nozzles of this type are well known in the prior art. An essential feature of simplex spray nozzles or atomizers is an interior space known as a swirl chamber. The swirl chamber usually has a generally cylindrical shape with a closed base surface at one end and a tapered or spherical surface at the other end; a discharge orifice forms an exit from the chamber at or near the apex of the tapered or spherical surface. One or more inlet passages admit liquid under pressure into the chamber in a direction generally tangential to the cylindrical axis. The tangential passages create a swirling fluid flow within the chamber, in the nature of a whirlpool; the whirlpool effect in turn creates a central low-pressure area that draws external air into the chamber through the discharge orifice. The low-pressure area that is created in this manner results in the formation of a central vortex in which an air core is surrounded by swirling liquid. It is well known that the interaction of air and liquid in the central vortex in turn produces a liquid spray made up of a myriad of tiny droplets of liquid as the contents of the swirl chamber are discharged continuously through the discharge orifice. In some prior nozzles, fluid has passed axially outwardly from such a swirl chamber into another chamber prior to passing through the discharge orifice. However, such two-chambered nozzles have had neither the structural nor the functional attributes of the present invention.

For certain applications, a spray pattern made up of tiny droplets of liquid is entirely satisfactory. For other applications such as for use in spraying oil into the combustion areas of gas turbine engines, oil burners and the like, sprays having different characteristics are preferred. It is particularly desirable to provide aerated sprays for combustion applications. This can be achieved by generating a spray containing bubbles wherein each bubble is a thin film of liquid surrounding an entrapped volume of air. It is known that sprays containing bubbles display enhanced and desirable combustion characteristics. This is believed to be due to improved air/fuel mixing and to more favorable stoichiometric ratios within the spray where ignition and burning occur. However, desirable levels of bubble formation are not readily obtainable in prior art nozzles of the simplex type, or with other known nozzle designs such as those in which air must be injected into the nozzle.

SUMMARY OF THE INVENTION

Accordingly, it is an object of this invention to provide an improved simplex nozzle having a design that is simple and economical to manufacture, and that provides reliable and significantly high levels of bubble formation in the discharge spray.

An important feature of this invention is an aspirating atomizer or spray nozzle of the simplex type having a second enclosed swirl chamber axially and rearwardly spaced from the first swirl chamber, and further having a fluid passage between the first and second chambers located so as to permit the vortex formed in the first chamber to extend axially into the second chamber.

BRIEF DESCRIPTION OF THE DRAWINGS

These and other objects, features and advantages of this invention will be described and made apparent from the following specification and the accompanying drawings, in which.

DESCRIPTION OF THE PREFERRED EMBODIMENTS

Figure 1:
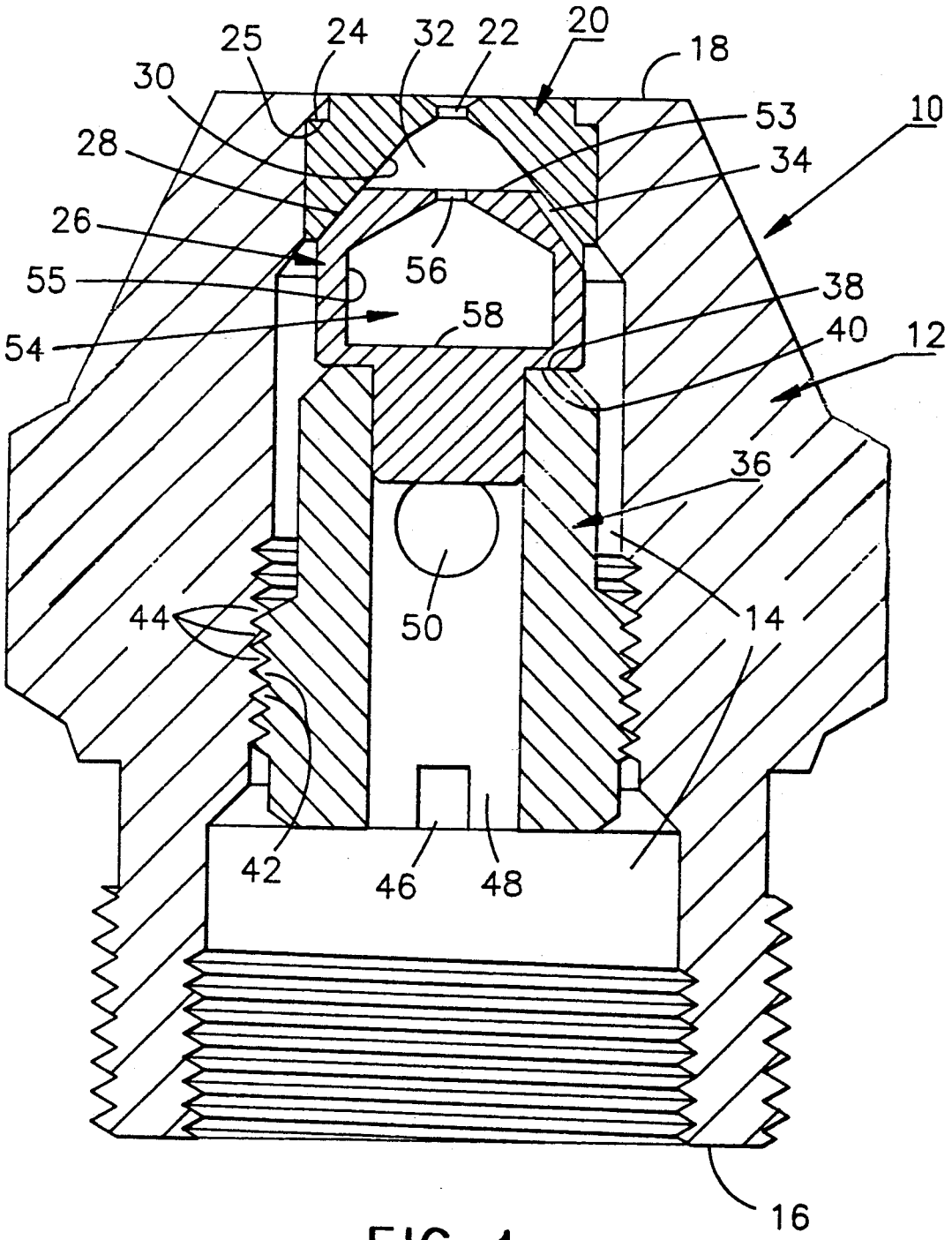
FIG. 1 represents a substantially enlarged cross-sectional view of an improved simplex-type spray nozzle or atomizer having first and second swirl chambers in accordance with the invention.

Now, referring to FIG. 1 of the drawings more specifically, a nozzle 10 constructed in accordance with this invention may be seen to comprise a body member 12 having a fluid conduit 14 extending axially from the rearward end 16 to the forward end 18. A nib element 20 having a discharge orifice 22 is positioned within conduit 14 toward the forward end 18 of body 12. The nib includes a forwardly facing peripheral shoulder 24 which engages a cooperating rearwardly facing shoulder 25 on the inner surface of conduit 14 to position the nib within the body 12.

A distributor member 26 is positioned within conduit 14 rearwardly of orifice 22 and nib 20. The forwardly facing surface 28 of the distributor engages rearwardly facing surface 30 of the nib 20. Accordingly, the nib 20 is held securely between shoulder 25 on body 12 and surface 28 of distributor 26. The nib 20 and distributor 26 are configured in a well-known manner to define between them an enclosed swirl chamber 32 in communication with discharge orifice 22.

One or more slots 34 formed in the forwardly facing surface 28 of distributor 26 provide a flow path permitting fluid within a forward portion of conduit 14 to enter swirl chamber 32. The slot or slots 34 are oriented and configured in a well-known manner to direct fluid flow in a manner which will create swirling fluid within the chamber for a purpose that is explained later in this specification.

The nib 20 and distributor 26 are retained in assembled position, as shown, within conduit 14 in body 12 by means of a retainer 36. The retainer is a generally cylindrical member having a forwardly facing seat 38 that abuts against a rearwardly facing, cooperating seat 40 on distributor 26. Exterior screw threads 42 on the outer periphery of retainer 36 engage mating threads 44 on the inner wall of conduit 14, so that when the retainer is rotated about its longitudinal axis within conduit 14, it is advanced axially and forwardly relative to body 12. The axially forward portion of retainer 36 moves distributor 26 toward nib 20, and in turn, seats nib 20 firmly against shoulder 25 to create a securely connected assembly of body 12, nib 20, distributor 26 and retainer 36, all in a manner well known in the prior art. To facilitate rotation of retainer 36, for advancement via threads 42 and 44, the retainer is provided with a transverse slot 46 that may be engaged readily by a screwdriver or other suitable implement.

In the embodiment illustrated in FIG. 1, it may be seen that the retainer would tend to obstruct the flow of liquid through conduit 14 because it occupies the full width of the conduit in the area of engagement between threads 42 and 44. To permit the desired flow of liquid through conduit 14, retainer 36 is provided with a central bore 48, and one or more transverse apertures 50 that extend through the retainer structure from bore 48 to the exterior, at a location forward of exterior threads 42. This well-known construction permits fluid entering conduit 14 at rearward end 16 to flow through bore 48 and through apertures 50 into that portion of conduit 14 which surrounds the forward part of retainer 36 and the rearward part of distributor 26, where it enters slots 34 and flows into chamber 32. Chamber 32 is bounded by generally annular wall 30 of nib 20 and when liquid under pressure enters chamber 32 through one or more passageways such as slots 34, it is set into swirling motion within chamber 32 in a well known manner. As the liquid swirls about within the chamber 32 in a generally orderly or laminar flow pattern, it creates a central low-pressure region along the longitudinal axis of the chamber. The low pressure results in an aspiration or inward flow of air, in the rearward direction relative to the nozzle, through the discharge orifice, from the relatively higher pressure air outside the nozzle. Within the chamber, the combination of swirling liquid and indrawn air is known to produce a vortex along the axis that mixes air and liquid together.

In the prior art, front face 53 of distributor 26 is generally flat or slightly shaped (e.g., concave), and serves as a clearly defined bottom for chamber 32. Accordingly, the maximum length of vortex that can be formed in a simplex atomizer of the type known in the prior art is equal to the axial distance between the discharge orifice 22 and front face 53 of distributor 26. The mixing of air and liquid within this limited distance in accordance with the prior art, is known to produce a spray comprising primarily liquid droplets with few, if any, bubbles. This characteristic is believed to be related to the fact that swirling flow within a conventional single swirl chamber is predominantly laminar in nature, and the vortex exists solely within a laminar flow environment.

In the embodiment of this invention shown in FIG. 1, a second swirl chamber 54 is formed entirely within the body of distributor 26. This second chamber has a generally annular wall 55, a floor surface 58 and an internal orifice 56 which communicates with first swirl chamber 32 through front face 53 and which is generally axially aligned with discharge orifice 22.

Figure 2:
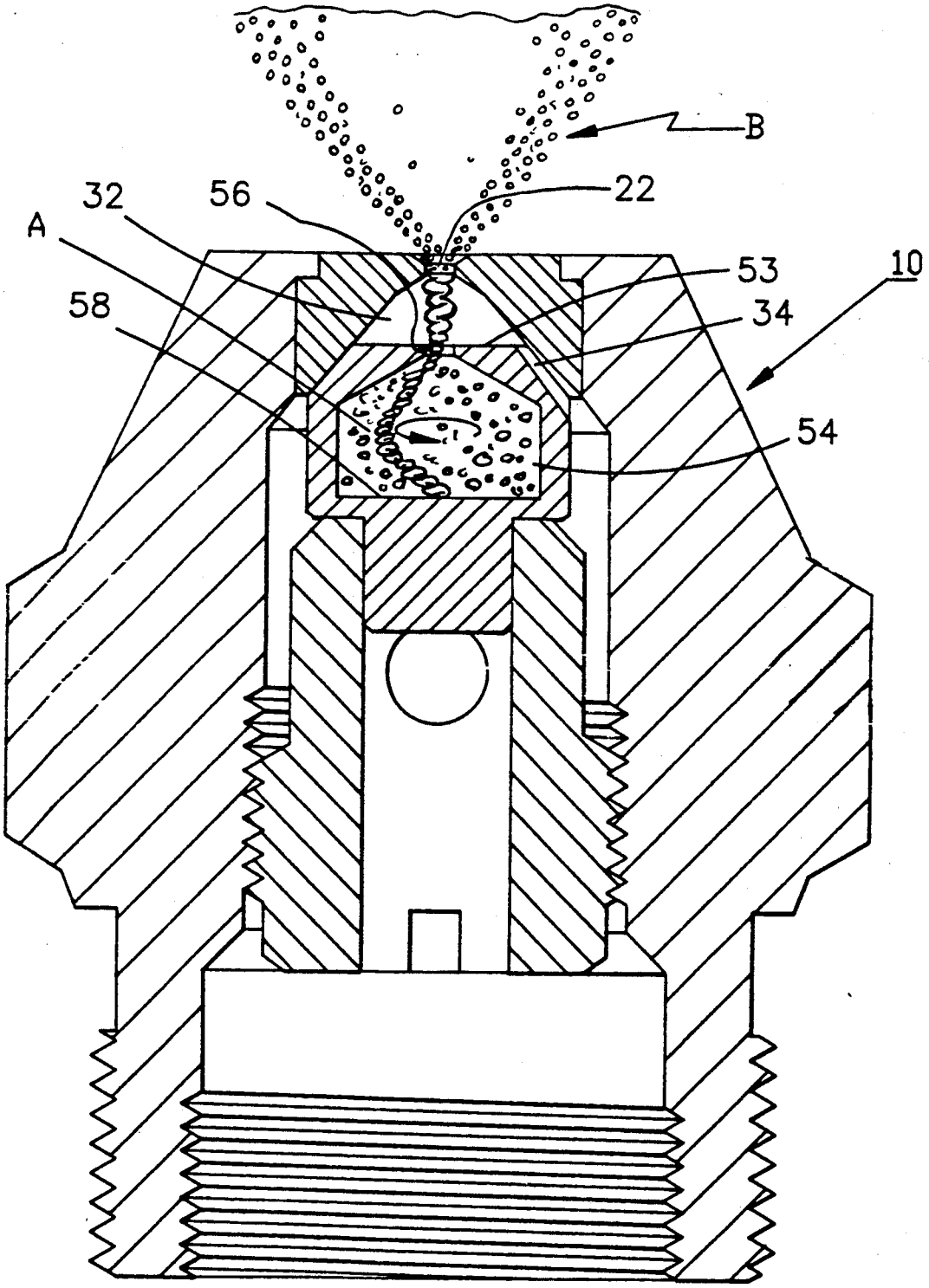
FIG. 2 represents the nozzle of FIG. 1, with an added representation of the central vortex and the spray pattern produced when the nozzle is in operation.

It has been discovered that the provision of the second swirl chamber 54 axially positioned rearwardly of primary chamber 32 and having an inner orifice 56 providing communication between the two chambers 32 and 54 permits and encourages the formation of a longer vortex shown as A in FIG. 2 of the drawings. In this context, the term "longer" indicates that the vortex has an axial length greater than the distance between discharge orifice 22 and front face 53 of distributor 26.

As illustrated in FIG. 2, the vortex extends axially through the first swirl chamber 32 and into the second chamber 54. It is believed that the fluid flow patterns in the two chambers 32 and 54 are substantially different; flow within chamber 32 is substantially laminar in nature because the swirling pattern is created by the direct, positive flow of fluid into chamber 32 through passage means such as slot 34. By contrast, there is no direct positive flow of fluid into chamber 54; rather, air and liquid enter chamber 54 through orifice 56 via vortex A. It is believed that the fluid flow pattern in chamber 54 is more chaotic and nonlaminar relative to the pattern in chamber 32. Typically, the air vortex in chamber 54 is thought to move about in a dynamic sinuous fashion (indicated in FIG. 2 by an arrow), producing a high degree of turbulence and aeration. The configuration of chamber 54, characterized by the presence and position of floor surface 58 which defines a finite axial length, is believed to affect the action of the vortex in a desirable and unexpected manner. Specifically, it has been discovered that a nozzle having the structure herein disclosed produces a spray discharge from orifice 22 that is characterized by a high proportion of bubbles as represented by the generally V-shaped pattern of tiny circles illustrated at B in FIG. 2. While the diameter of internal orifice 56 may be equal to or slightly greater than that of discharge orifice 22, based on experimental results recorded thus far, it appears that superior performance is obtained when the diameter of internal orifice 56 is less than that of discharge orifice 22. It has also been observed that while the axial length of swirl chamber 54 may be equal to or greater than that of its width or diameter, superior results have been obtained when the axial length of the chamber is less than its diameter.

Figure 3:
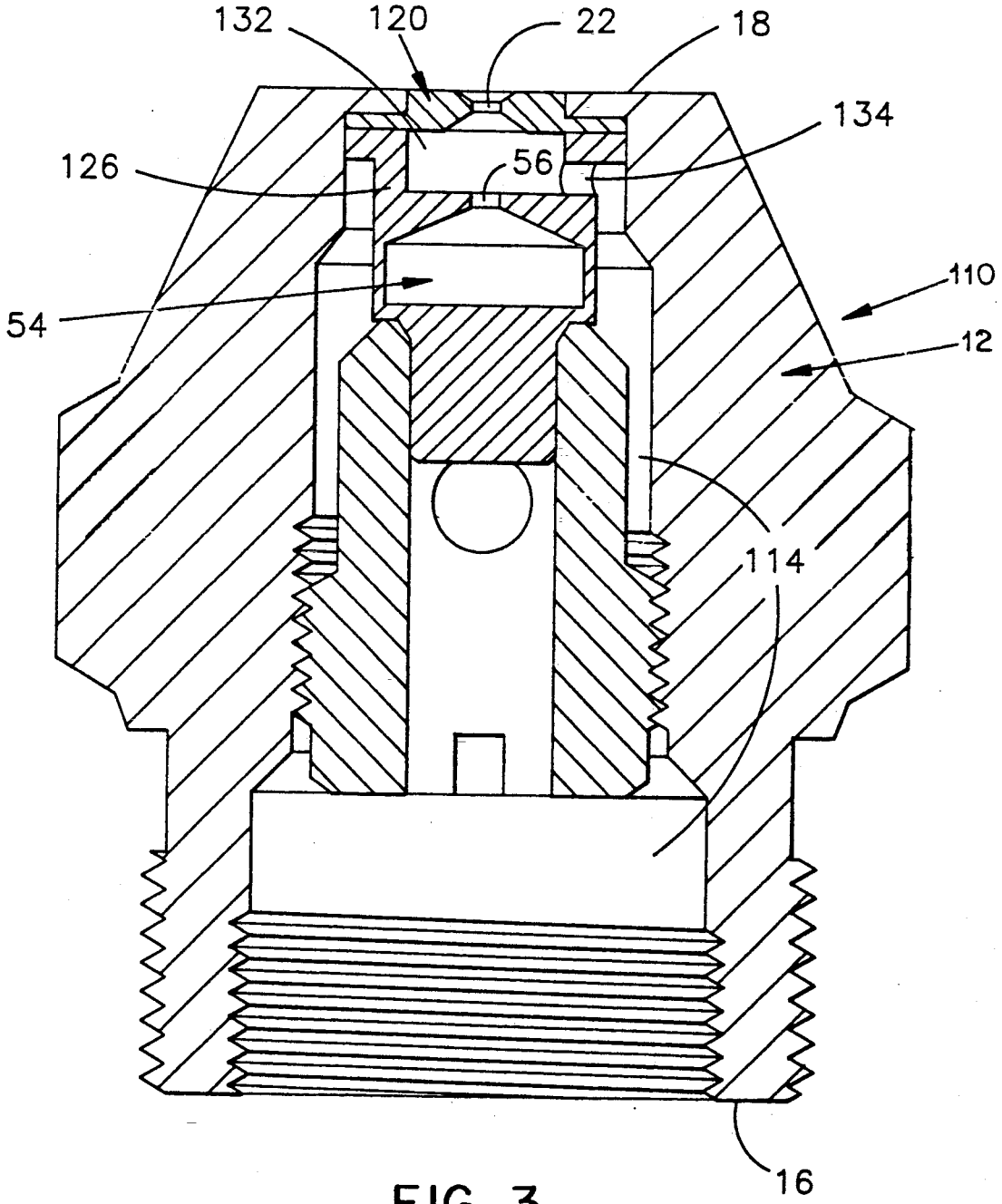
FIG. 3 represents a substantially enlarged cross-sectional view of a second embodiment in accordance with the invention.

A second embodiment of the invention is shown in FIG. 3 wherein substantially like elements are identified with same numerals. Thus, spray nozzle 110 comprises a body member 12 having a fluid conduit 114 extending from rearward end 16 to forward end 18 of body member 12, a nib element 120 having a discharge orifice 22 and positioned within conduit 114 toward the forward end 18 of body 12 and a distributor member 126 positioned within conduit 114 and rearwardly of nib 120. A first swirl chamber 132 is located directly behind discharge orifice 22 and a second swirl chamber 54 is located within distributor member 126 directly behind first swirl chamber 132 and in fluid communication therewith via internal orifice 56. Fluid conduit 114 differs from conduit 14 of FIG. 1 in that the discharge of liquid into first swirl chamber 32 is via at least one passageway 134 and is perpendicular to the axis of nozzle 110 instead of at an oblique angle as via slot or slots 34 of FIG. 1. In all other respects the nozzles of FIGS. 1 and 3 are believed to function in a similar manner.

While preferred embodiments of the invention have been shown and described in detail, other modifications will be readily apparent to those skilled in the art of spray nozzles or atomizers. For example, various of the individual elements, such as the nib and the nozzle body, may be made integral with one another if so desired. Also, those skilled in the art will recognize that the use of gaskets and seals between the various nozzle components is sometimes appropriate. However, such elements form no part of the invention and have therefore been omitted from the drawings and the specification in the interests of simplicity. Thus, the preceding specification should be interpreted as exemplary rather than as limiting and the scope of the invention is defined by the following claims.

We claim:

1. A spray nozzle comprising:

a body member having a fluid conduit extending from a rearward end to a forward end;

a discharge orifice at the forward end of said fluid conduit;

a first swirl chamber in said nozzle, positioned rearwardly of said discharge orifice;

means in said nozzle for introducing liquid under pressure from said fluid conduit into said first swirl chamber so as to create an air vortex within said first swirl chamber; and a second swirl chamber positioned axially rearwardly of said first swirl chamber, and having an internal orifice and a floor surface spaced rearwardly from, and in opposed relationship to, said internal orifice; said internal orifice positioned between said first and second swirl chambers and permitting said air vortex formed in said first swirl chamber to extend axially into said second swirl chamber.

2. The nozzle of claim 1 wherein the diameter of the internal orifice is less than the diameter of the discharge orifice.

3. The nozzle of claim 1 wherein the axial length of the second swirl chamber is less than its diameter.

4. The nozzle of claim 1 wherein said liquid introducing means comprises a fluid passage having at least one passageway oriented to cause liquid to enter said first swirl chamber tangentially and at an oblique angle to the longitudinal axis of said nozzle.

5. The nozzle of claim 1 wherein said liquid introducing means comprises a fluid passage having at least one passageway oriented to cause liquid to enter said first swirl chamber tangentially and perpendicular to the longitudinal axis of said nozzle.

6. A spray nozzle comprising:

a body member having a fluid conduit extending from a rearward end to a forward end;

a discharge orifice at the forward end of said fluid conduit;

a distributor member in said fluid conduit, positioned rearwardly of said discharge orifice;

a first swirl chamber in said nozzle between said orifice and said distributor member and having a generally annular wall;

means in said nozzle for introducing liquid under pressure from said fluid conduit into said first swirl chamber so as to create an air vortex within said first swirl chamber;

a second swirl chamber in said nozzle formed entirely within said distributor member and having a generally annular wall, an internal orifice, and a floor surface spaced rearwardly from, and in opposed relationship to said internal orifice; and said internal orifice positioned between said first and second swirl chambers and permitting said air vortex formed in said first swirl chamber to extend axially into said second swirl chamber.

7. The nozzle of claim 6 wherein the diameter of the internal orifice is less than the diameter of the discharge orifice.

8. The nozzle of claim 6 wherein the axial length of the second swirl chamber is less than its diameter.

9. The nozzle of claim 6 wherein said liquid introducing means comprises at least one passageway formed in the forwardly facing surface of said distributor member and oriented to cause fluid to enter said first swirl chamber tangent to the wall defining said chamber and at an oblique angle to the longitudinal axis of said nozzle.

10. The nozzle of claim 6 wherein said liquid introducing means comprises at least one passageway formed in the forwardly facing surface of said distributor member and oriented to cause fluid to enter said first swirl chamber tangent to the wall defining said chamber and perpendicular to the longitudinal axis of said nozzle.

11. A simplex spray nozzle having a body member, a discharge orifice at a discharge end of said nozzle, a first swirl chamber having a generally annular wall and positioned axially inwardly of said discharge orifice, means for passing liquid through a conduit from an inlet end of said nozzle and causing said liquid to enter said first swirl chamber under pressure and tangentially to said generally annular wall, said nozzle characterized by a second swirl chamber also having a generally annular wall and positioned axially rearwardly of said first swirl chamber and an internal orifice positioned between and connecting said first and second swirl chambers to permit an air vortex formed in said first chamber by said liquid to extend axially into said second chamber.

12. The nozzle of claim 11 wherein the diameter of the internal orifice is less than the diameter of the discharge orifice.

13. The nozzle of claim 11 wherein the axial length of the second swirl chamber is less than its diameter.

14. The nozzle of claim 11 wherein said liquid enters said first swirl chamber at an oblique angle to the longitudinal axis of said nozzle.

15. The nozzle of claim 11 wherein said liquid enters said first swirl chamber perpendicular to the longitudinal axis of said nozzle.

* * * * *